United States Patent [19]

Lovmark

[11] 4,199,836

[45] Apr. 29, 1980

[54] PAINT PAN

[76] Inventor: August O. Lovmark, P.O. Box 10471, South Lake Tahoe, Calif. 95731

[21] Appl. No.: 29,659

[22] Filed: Apr. 13, 1979

[51] Int. Cl.[2] ..... B44D 3/12

[52] U.S. Cl. ..... 15/257.06

[58] Field of Search ..... 15/257.06; 206/561

[56] References Cited

U.S. PATENT DOCUMENTS

| | | | |
|---|---|---|---|
| 2,402,346 | 6/1946 | Rosenlund | 15/257.06 |
| 2,669,736 | 2/1954 | Wabnitz | 15/257.06 |
| 2,694,825 | 11/1954 | Touchett et al. | 15/257.06 |
| 3,110,921 | 11/1963 | Conner | 15/257.06 |
| 3,837,034 | 9/1974 | Leffert et al. | 15/257.06 |
| 3,940,824 | 3/1976 | Gioia et al. | 15/257.06 |

*Primary Examiner*—Edward L. Roberts

*Attorney, Agent, or Firm*—Warren, Chickering & Grunewald

[57] ABSTRACT

A paint pan including a shallow pan portion terminating in a reservoir, the reservoir having a common wall with the pan portion, the common wall sloping such that the bottom of the reservoir is narrower than the top, and the sloping wall including a passageway for paint to flow from the reservoir onto the deck of the pan with a hinged valve element in the reservoir which swings from an open position in the reservoir to a closed position covering the passageway and having an actuating element extending through the passageway to a position above the deck of the paint pan.

4 Claims, 2 Drawing Figures

PAINT PAN

BACKGROUND OF THE INVENTION

Pans for use with paint rollers have been employed for many years. The simplest of such pans are in the form of a deck which is at an angle to horizontal when in normal use and surrounded by side walls to form a pan that is deeper at one end than at the other. The deep end of the pan provides a small reservoir for paint, while the shallow end of the pan is used to distribute the paint on the roller. Paint is moved from the reservoir to the deck of the pan by dipping the roller into the reservoir and then rolling it back and forth across the deck to distribute the paint evenly on the roller.

The best use of a paint roller is obtained when only the nap of the roller is saturated with paint. When the sides of the roller are coated with paint, and when the ends of the mechanism holding the roller are coated with paint, paint tends to drip from the roller and large particles are propelled from it by centrifical force when the roller is operated. These sources of paint are a frequent cause of unsightly drips. A typical paint pan having this construction is described and shown in U.S. Pat. No. 2,694,825.

Another major problem with pans described above is the limited capacity of the reservoir. Since the reservoir can contain only a small amount of paint, it is necessary to replenish the supply of paint in the reservoir frequently; which is annoying and time consuming, particularly when painting on a ladder or a scaffold. Another problem associated with pans of the prior art is that as the reservoir becomes fuller, the deck area becomes less extensive and it becomes more difficult to distribute paint evenly on the roller.

A number of paint pans have been made in the past with increased capacity in the reservoir. Although these pans solve the problem of having to frequently refill the reservoir, in general they aggravate the problem of applying paint only to the nap of the roller because the roller, in being dipped into a deeper reservoir, is generally submerged to a deeper level. Typical examples of paint pans with large reservoirs are shown in U.S. Pat. Nos. 3,110,921; 3,837,034; and 3,940,824.

SUMMARY OF THE INVENTION

This invention is a paint pan that overcomes or greatly mitigates the problems enumerated above. The paint pan of this invention includes a shallow pan or receptacle portion having side walls and an end wall with a bottom deck wide enough to accept a paint roller. Contiguous with this shallow pan is a deep reservoir for paint which extends above the level of the deck of the paint pan and is connected to the deck of the paint pan through a paint supply passageway in a sloping wall that is common both to the pan and to the reservoir. The sloping wall slopes so that the top of the reservoir is wider than the bottom of the reservoir. A hinged valve element is provided on the sloping wall so that it moves within the reservoir from an open position to a closed position. The valve element overlays the paint passageway in the sloped wall and it is held in the closed position both by gravity and by the hydrostatic pressure of paint when the reservoir is full. The valve element includes a projecting actuating element which extends to a position above the deck of the pan portion such that it can be physically moved; for example, by being pushed with a paint roller to move the valve element from the closed position to the open position.

In addition to the sloping side wall, the reservoir portion of the paint pan of this invention has a bottom floor that is not horizontal in normal operating position and one that slopes downwardly toward the paint passageway. The device of this invention may be provided with suitable legs to maintain its correct orientation when in use and with ladder hooks, an embossed deck, and other elements to improve the utility of the device.

DETAILED DESCRIPTION OF THE INVENTION

This invention may be better described with reference to the accompanying drawings.

Figure 2:
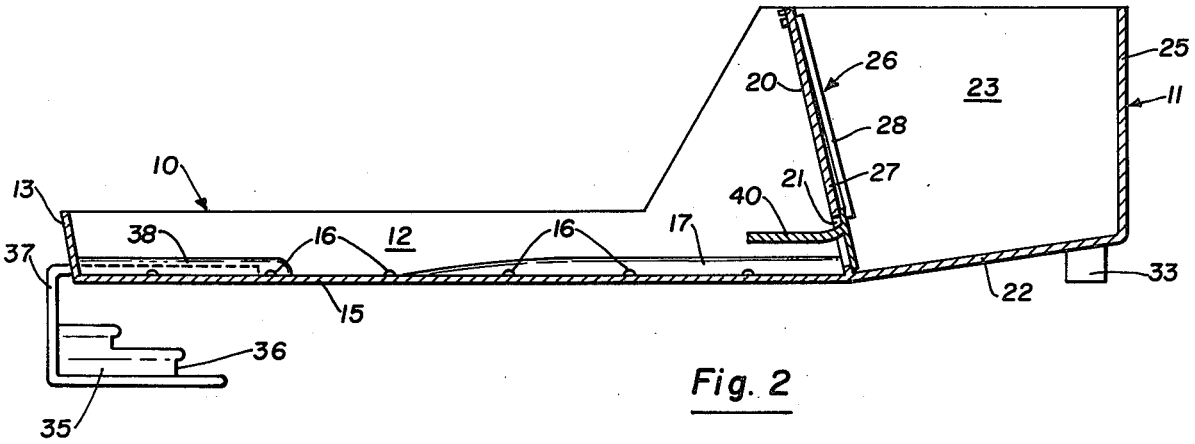
FIG. 2 is a cross section of the paint pan illustrated in FIG. 1 taken along the line 2—2.
Figure 1:
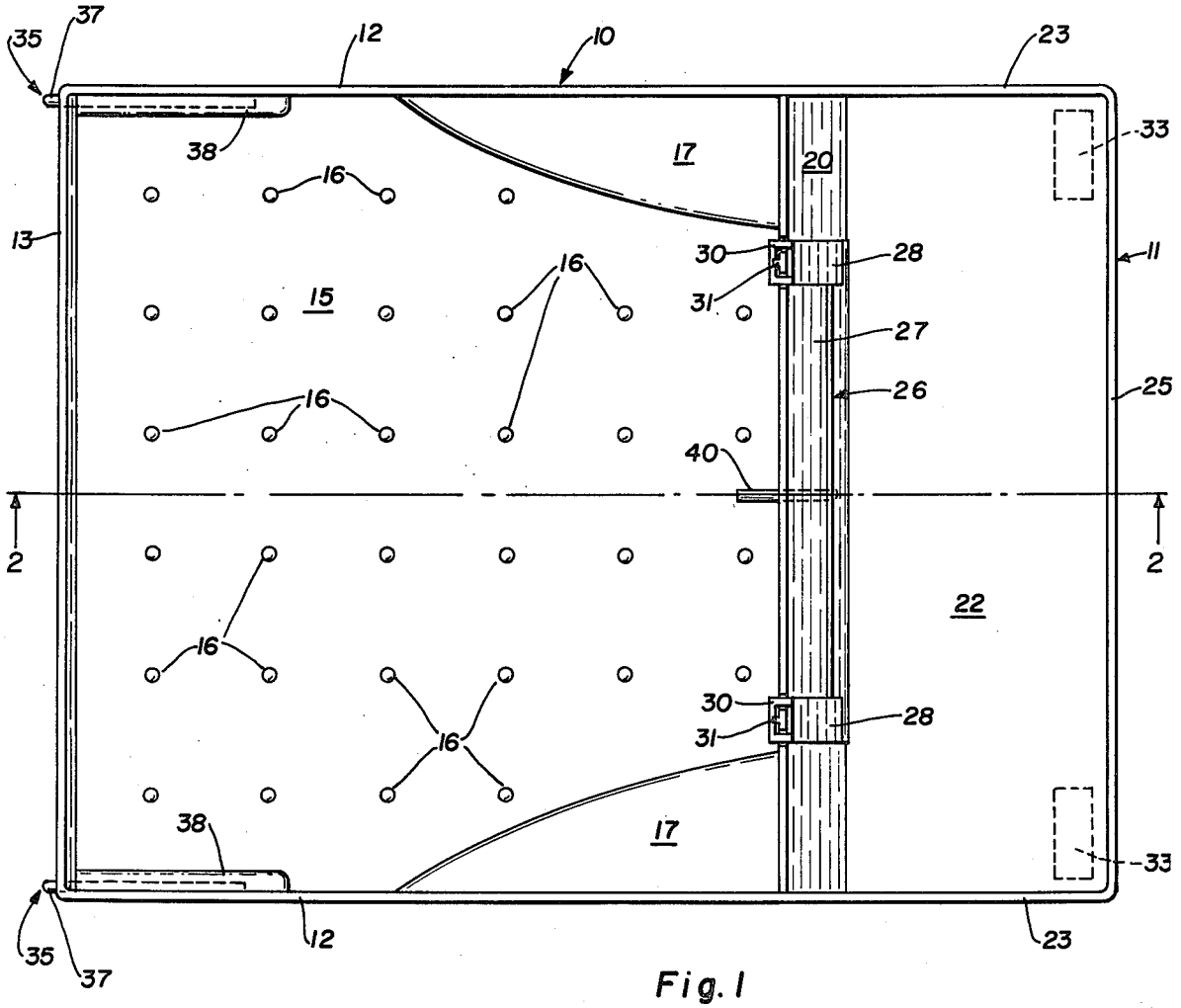
FIG. 1 is a plan view of a paint pan embodying the invention.

The paint pan illustrated in FIGS. 1 and 2, although a single, integral unit, includes a paint pan portion generally designated 10 and a reservoir portion generally designated 11. The paint pan portion includes two side walls 12 and an end wall 13 which surround a deck 15. The deck 15 preferably is provided with a pattern of embossments 16 to aid rotation of a roller and even distribution of paint. The deck 15 is also provided with raised elements 17 which aid in even distribution of paint and prevent the roller from becoming too deeply immersed in paint at any time when paint is flowing onto the deck from the reservoir 11.

The area of the deck in plan view is substantially larger than the area of the reservoir. Accordingly, the amount of paint in the reservoir, if it were all introduced into the pan portion 10, would fill the pan portion 10 to a much lesser depth. Accordingly, in a preferred embodiment of this invention the height of side walls 12 and end wall 13 is such that the volume of paint capable of being held by the pan portion 10 is at least equal to the volume of paint capable of being held by the reservoir 11. With this arrangement of parts a catastrophic failure of the valve between the reservoir and the pan or a slow leak of an unattended pan would prevent any spillage of paint beyond the confines of the pan of this invention.

Sloping wall 20 is common both to the pan portion 10 and the reservoir 11. Sloping wall 20 is provided with a passageway 21 through a lower portion thereof; the passageway 21 opening at or very close to the bottommost portion of reservoir floor 22. The reservoir also includes side walls 23 and a rear wall 25. The uppermost portion of side walls 23, rear wall 25, and sloping wall 20 are at substantially the same level when the paint pan of this invention is oriented for normal use.

A valve element generally designated 26 is held with some hinge arrangement to the reservoir side of sloping wall 20. Sloping wall 20 must slope toward the interior of the reservoir portion, and as such, the valve element generally designated 26 is held by gravity against opening 21 in the sloping wall 20. The valve element 26 includes a closure portion 27 that superimposes opening 21. Valve element 26 also includes extensions 28 which connect the closure element 27 to the hinge portions 30, here illustrated as an expanded portion of extension 28 having a central hole through which a tongue 31 cut in the top portion of sloping wall 20 protrudes. It is evident that any suitable hinge arrangement between sloping wall 20 and valve element 26 may be used; preferably one that is easily dismantled for cleaning.

In preferred embodiments of this invention, legs 33 may be employed to insure the stability of the paint pan of this invention and to prevent the pan from rocking back if one would lean on the wall 25 when the reservoir was filled with paint. Additionally, the paint pan of this invention is provided with a ladder hook generally designated 35 which, in this embodiment, is provided with a stepped end 36 so that the ladder hook may be fitted over rungs of various thicknesses. The ladder hook is connected to a paint pan of this invention by an L-shaped projection 37 which connects to the ladder holding element 35 and slides snugly into a receiving channel 38 formed in the bottom of the pan portion 10. Ladder hooks 35 also can swivel in receiving channel 38 so that they can be swung out from under the pan when not used to connect it to a ladder.

Finally, a protruding element 40 is connected to the valve element 26 in such a manner that it projects through passageway 21 to a position overlying the deck 15. Preferably, projection 40 will extend far enough over deck 15 so that it extends beyond any portion of sloping wall 20. In this manner, even large diameter rollers may be employed with the paint pan of this invention and they will still be able to move the projection or actuating element 40 to move the valve element 26 away from opening 21 and to permit paint to flow through passageway 21 from the reservoir 11 to the pan 10.

In use, the paint pan of this invention is located in a normal operating position which normally will have the deck 15 horizontal and the paint in the reservoir at a higher elevation than the deck. The reservoir 11 is filled with paint and, through the action of gravity and the hydrostatic pressure of paint, the valve element 26 is maintained tightly in the closed position so that no paint can flow between the reservoir 11 and the pan 10. When it is desired to begin painting, the actuator 40 is moved, preferably with the paint roller, to open the passageway 21 for a sufficient period of time to have paint flow from the reservoir portion 11 to the pan portion 10. The paint roller normally will be bridged across the raised portion 17 so that paint will flow beneath it, but the paint will be distributed by natural flow patterns and by the pattern of embossment 16 so that it will cover the deck 15 evenly. The action of the paint roller on deck 15 will help distribute the paint evenly, but the general construction of the device of this invention will prevent the paint on the deck 15 from being so deep that it will saturate portions of the paint roller where no paint is desired. The paint on the deck 15 may be used very economically, and when insufficient paint remains on deck 15, actuator 40 may again be bumped with the roller to permit more flow of paint from the reservoir 11 to the deck 10. In a preferred use of the invention, the actuator 40 is moved to permit more paint to flow onto deck 15 immediately after the roller is saturated with paint so that the flow of paint onto deck 15 and its uniform distribution across deck 15 can take place while the roller is employed to paint a surface.

Another advantage of the paint pan of this invention is that reservoir 11 provides an easy supply of paint to be used with a paint brush. In employing a roller to paint walls; for example, paint brushes are frequently employed to adequately cover corners and spaces around doors and windows. With the device of this invention, it is not necessary to have a separate can of paint to obtain a supply reasonably suited for use with a paint brush in that the reservoir portion 11 provides a deep supply of paint and adequate side walls for scraping the brush to avoid excess paint on the bristles in a manner such that the excess paint will run back and join the supply of paint in the reservoir.

What is claimed is:

1. A pan for use with a paint roller comprising:

a shallow receptacle having side walls, an end wall, and a bottom deck wide enough to accept a paint roller;

a contiguous reservoir for paint extending above said deck and connecting to said deck through a paint supply passageway in a wall sloping so that the top of said reservoir is wider than the bottom of said reservoir;

said reservoir having a floor sloping toward said passageway;

a valve element hinged to said sloping wall and moveable within said reservoir between an open position and a closed position;

said valve element including a closure portion which is adapted to overlay said passageway in said closed position; and actuating means extending from said valve element to a position above said deck whereby movement of said actuating means effects movement of said valve element from said closed position and gravity and hydrostatic pressure of paint urge said valve element toward said closed position.

2. The pan of claim 1 wherein the volume of said shallow receptacle is sufficient to contain at least the volume of said reservoir.

3. The pan of claim 1 including a pattern of embossments on said deck.

4. The pan of claim 1 including ladder hooks on the side of said pan opposite said reservoir.

* * * * *